US007004106B1

(12) United States Patent
Forance

(10) Patent No.: US 7,004,106 B1
(45) Date of Patent: Feb. 28, 2006

(54) ELASTIC CORD BOOKMARK

(76) Inventor: JoAnn Pearl Forance, 9060 Paseo De Valencia St., Fort Myers, FL (US) 33908

( * ) Notice: Subject to any disclaimer, the term of this patent is extended or adjusted under 35 U.S.C. 154(b) by 0 days.

(21) Appl. No.: 10/885,254

(22) Filed: Jul. 6, 2004

Related U.S. Application Data

(63) Continuation-in-part of application No. 10/270,431, filed on Oct. 15, 2002, now abandoned.

(51) Int. Cl.
*B42D 9/00* (2006.01)

(52) U.S. Cl. ..... 116/238; 116/234

(58) Field of Classification Search ..... 116/234–240; 281/42

See application file for complete search history.

(56) References Cited

U.S. PATENT DOCUMENTS

| | | | | | |
|---|---|---|---|---|---|
| 139,936 | A | * | 6/1873 | Ward et al. | 116/235 |
| 370,525 | A | * | 9/1887 | Bieber | 281/42 |
| 480,649 | A | * | 8/1892 | Bailey et al. | 116/235 |
| 1,809,943 | A | * | 6/1931 | Ockenden | 116/239 |
| 1,999,583 | A | * | 4/1935 | Bouvier | 281/42 |
| 2,716,390 | A | * | 8/1955 | Goins | 116/235 |
| 3,898,951 | A | * | 8/1975 | Clare | 116/239 |
| 4,041,892 | A | * | 8/1977 | Nichols | 116/239 |
| 4,162,800 | A | * | 7/1979 | Gonot et al. | 281/42 |
| 4,505,219 | A | * | 3/1985 | Mangano | 116/234 |
| 5,022,342 | A | * | 6/1991 | Davis | 116/236 |
| 5,054,816 | A | * | 10/1991 | Rosengarten | 281/42 |
| D346,399 | S | * | 4/1994 | Schad et al. | D19/34 |
| 5,375,884 | A | * | 12/1994 | Farrington | 281/42 |
| 5,443,029 | A | * | 8/1995 | Garnet | 116/235 |
| 5,458,081 | A | * | 10/1995 | Reichert | 116/234 |
| D380,776 | S | * | 7/1997 | Boshart | D19/34 |
| 6,109,204 | A | * | 8/2000 | Hoey et al. | 116/234 |
| 6,446,803 | B1 | * | 9/2002 | McKinney | 206/371 |
| 6,854,417 | B1 | * | 2/2005 | Stephens | 116/238 |
| 2003/0168847 | A1 | * | 9/2003 | Palamidessi | 281/42 |

* cited by examiner

*Primary Examiner*—R. Alexander Smith
(74) *Attorney, Agent, or Firm*—William E. Noonan

(57) ABSTRACT

A bookmark device includes an elastically stretchable loop section that has a first longitudinally resilient cord wrappably attachable to a book being engaged with the book such that the first cord extends across an exterior of the book in between front and back covers of the book at a selected location. An elastically stretchable tail section includes a second longitudinally resilient cord joined to and extending from the loop section. The tail section projects from a first end of the book to which the loop section is attached and is insertible between a selected pair of adjoining pages of the book to mark a corresponding position therein. Each of the first and second cords constitutes a string. The tail has a distal end for extending no farther than an opposite end of the book when the tail section is in an unstretched condition. A tab carried proximate the distal end of the tail section is pulled to stretch the tail section beyond the opposite second end of the book and is released to engage that end and hold the tail section in place in the marked position of the book.

17 Claims, 3 Drawing Sheets

ELASTIC CORD BOOKMARK

RELATED APPLICATION

This application is a continuation in part of U.S. patent application Ser. No. 10/270,431 filed Oct. 15, 2002 now abandoned.

FIELD OF THE INVENTION

This invention relates to a bookmark, including a loop section and a tail section comprising a resilient fiber cord. The loop section is attached to and releasably grips the cover of a book and the tail portion is inserted between the pages to mark a selected position in the book. A marker is manipulated and a retention element engages an edge of the book to hold the tail section in place with a slight pull exerted by the tail section.

BACKGROUND OF THE INVENTION

Conventional bookmarks exhibit a number of disadvantages. Most do not remain securely in place between the pages of the book. The bookmark is apt to fall out of the book when the book is moved or accidentally dropped. As a result, the reader may lose his or her place in the book. Conventional bookmarks are also easy to misplace and are subject to wear and tear over time.

A number of known devices have utilized a strap or band for attaching to the book and carrying an elongate marker that is disposed between selected pages of the book to mark a desired position in the book. See Clare, U.S. Pat. No. 3,898,951 and Nichols U.S. Pat. No. 4,041,892. These are rather bulky and unattractive products that are not convenient to use. The band or strap tends to be fairly thick and cumbersome. Attaching and removing the strap from a book can be time consuming, tedious and annoying. Pages and other portions of the book may be torn or otherwise damaged as the strap is attached or removed. Moreover, these bookmarks are rather unattractive. The strap must be wrapped obtrusively about the front or back cover of the book. In each case, the marker extends loosely between selected pages being marked. None of the known products includes any means of reliably securing the marker portion in place between the pages. As a result, if the book is picked up or accidentally dropped, the marker is likely to become dislodged from the book so that the reader loses his or her place. This can be extremely frustrating and totally defeats the purpose of using the bookmark.

SUMMARY OF THE INVENTION

It is therefore an object of the present invention to provide an elastic cord bookmark that enables books of all sizes to be securely and reliably marked so that the reader can quickly and conveniently return to the marked position in the book.

It is a further object of this invention to provide a bookmark that is extremely easy to attach to and remove from a book and which does not damage the book during this process.

It is a further object of this invention to provide a bookmark that holds the marked spot much more securely and reliably than conventional bookmarks and which resists falling from the book or otherwise becoming dislodged from the book when the book is picked up, moved or accidentally dropped.

It is a further object of this invention to provide a bookmark that presents an attractive, unobtrusive appearance.

It is a further object of this invention to provide a bookmark that is less bulky and awkward to use than prior bookmarks.

It is a further object of this invention to provide a bookmark that remains securely attached to a cover of the book so that it is not easily lost or misplaced, and which effectively resists wear and tear even during prolonged usage.

It is a further object of this invention to provide a bookmark that is easy and convenient to repeatedly reuse and transfer from book to book.

It is a further object of this invention to provide a bookmark that remains securely attached to the book without tearing the pages or otherwise causing damage to the book and which is suitable for use with virtually all types and sizes of books, including paperbacks.

This invention results from a realization that an improved, effective and aesthetically attractive bookmark may be achieved by employing a single elastic string that is attached to itself to form a loop section for engaging a book to be marked and a tail section that is placed between selected pages of the book to mark that place in the book. By employing a thin string, the bookmark is able to be inserted onto the book such that the loop extends snugly across the cover and the inside seam of the book. The book is allowed to fully close with the bookmark device attached and an attractive appearance is presented. The thin string construction prevents damage from being done to the book as the bookmark device is attached and removed.

This invention further results from a further realization that by employing a resilient tail section that is shorter than the height of the book and carrying a gripping tab at the distal end of the tail section, a secure and reliable marking operation is performed. The tab is grabbed and the tail is stretched beyond the lower end of the book. The tab is then released so that is engages and grips the lower end of the book. This holds or anchors the bookmark securely in place in the marked position.

This invention features a bookmark device including an elastically stretchable loop section that includes a first longitudinally resilient cord wrappable attachable to a book in gripping engagement with the book such that the first cord section extends across an exterior of the book and between front and back covers of the book at a selected location. An elastically stretchable tail section includes a second longitudinally resilient cord joined to and extending from the loop. The tail projects from a first end of the book to which the loop is attached and is insertible between a selected pair of adjoining pages of the book to mark a corresponding position therein. Each of the cords constitutes an elastic string. The tail has a distal end for extending no farther than an opposite second end of the book when the tail is in unstretched condition. A tab is carried proximate the distal end of the tail for being pulled to stretch the tail beyond the opposite second end of the book and for being released to engage that end and hold the tail in place in the marked position of the book.

In a preferred embodiment, the first and second cord sections constitute a single unitary string. The elastic string may include a micro-cord. The string may have a cross-sectional thickness of at least 1/64" and not greater than 1/16". The unitary string may have a substantially uniform cross-sectional thickness. The string may be configured for radially twisting or rotating as the loop section is engaged with the book to facilitate attachment of the loop to and removal of the loop from the book.

The tab may include a grippable marking member that is grasped by a user for stretching and selectively positioning the tail and an anchoring element for engaging the pages at the second end of the book when the gripping member is released to hold the tail in place with a stretch in the marked position of the book. The anchoring element may include a cup-shaped element having a plurality of notches formed along a peripheral edge thereof for receiving pages at the second end of the book to engage the anchoring element with those pages. The marking member may include an ornamental charm. The marking member and the anchoring element may be attached to the second cord section and interconnected by a second, smaller loop proximate a distal end of the tail section.

This invention also features a bookmark device including an elastically stretchable loop section as previously described and a plurality of elastically stretchable tail sections, each of which is attached to and extends from the loop. In this embodiment, the loop and tails again comprise respective segments of a thin resilient string.

DETAILED DESCRIPTION OF PREFERRED EMBODIMENTS

Other objects, features and advantages will occur from the following description of a preferred embodiment and the accompanying drawings, in which.

Figure 5:
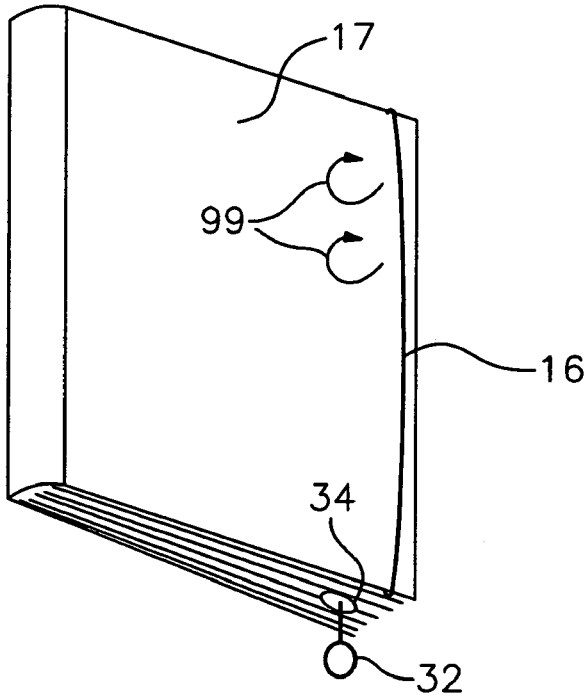
Figure 6:
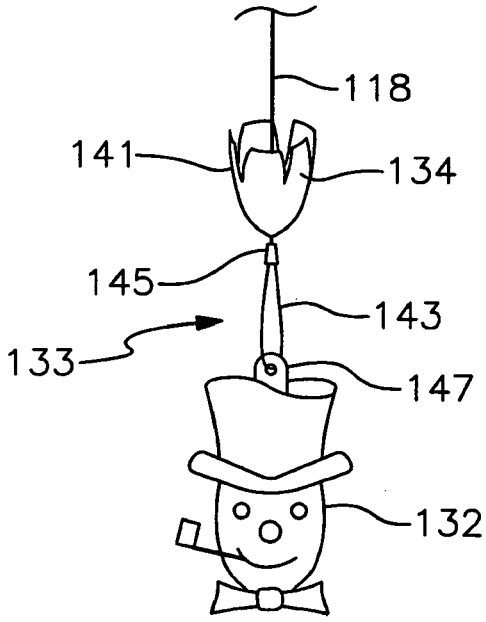

FIG. 5 is a bottom perspective view of the book in a closed condition with the bookmark engaged with the bottom of the book such that the tab is positioned beneath a lower edge of the book with the holder element in engagement with the book to mark a selected position in the book; and FIG. 6 is a perspective view of a distal end of the tail of the bookmark device, which carries an ornamental marking tab.

Figure 1:
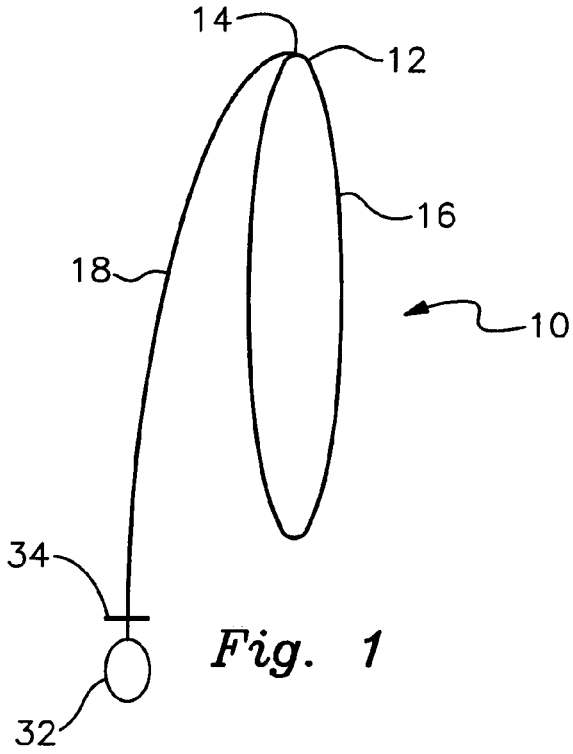
FIG. 1 is an elevational view of a preferred version of the bookmark employing a single tail section.

There is shown in FIG. 1 a single strand version of the bookmark 10 of this invention. A single unitary strand 12 of elasticized cord constituting an elastic string or bungee with a 2:1 stretch is looped and fused, crimped or bound at 14 to form a loop section 16 and a tail section 18. The string comprises micro-cord having a thin, substantially uniform (i.e. circular) cross-sectional thickness. As used herein, "string" means that the cord is slender and features a uniform or virtually uniform thickness in all cross-sectional dimensions, in contrast to a strap or band that has a relatively broad width or flat configuration. The cord is typically approximately 1/32" in diameter. Differing diameters may be employed for larger and smaller bookmarks. In all cases, however, the diameter of the micro-cord should be no greater than 1/16" so that is remains relatively compact and unobtrusive and does not damage the book as it is being installed and removed. Cord 12 should be at least 1/64" thick to provide adequate strength and resist breaking. The cord is fused, crimped or otherwise bound to itself at a length of approximately 6.25", which again may vary for different sizes of bookmarks. Typically, the tail has a length of approximately 8.5". This length again may be varied for larger and smaller products. The foregoing cord diameters refer to the unstretched condition.

Figure 3:
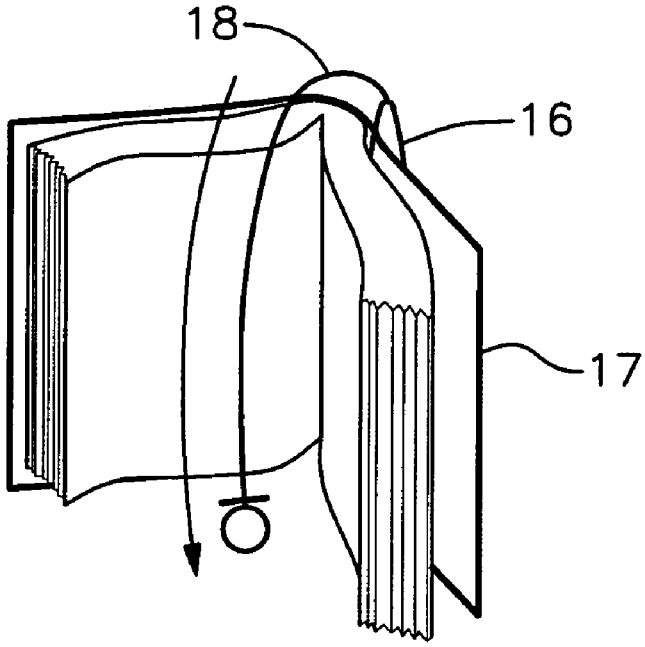
FIG. 3 is a perspective view of a book having the bookmark of this invention attached to the back cover of a book such that the tail section extends between a selected pair of pages.
Figure 4:
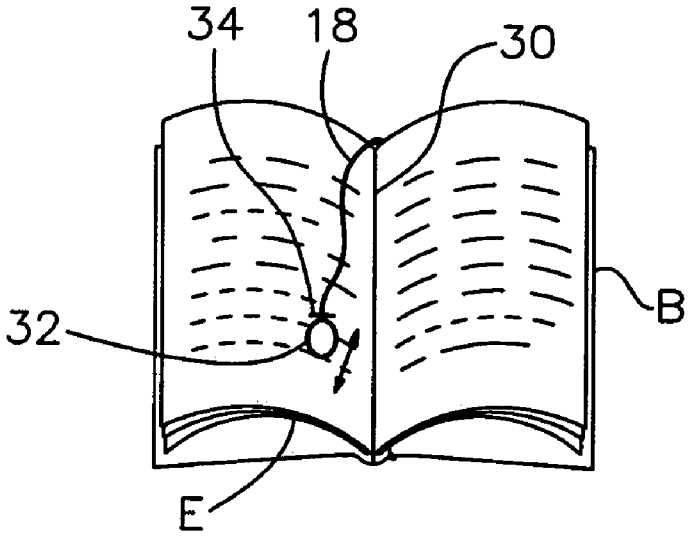
FIG. 4 is a perspective view of the tail section extending between the pages of an open book in an unstretched condition.

As shown in FIGS. 3–5, loop section 16 is typically applied to the back cover of a book such that the loop section snugly encircles the back cover with tail section 18 projecting out from the top end of the book proximate the spine. The bookmark temporarily attaches to the back cover of the book such that becomes a part of the book until it is selectively removed by the reader. The tail section 18 can then be placed freely along the inside seam along any selected page of the book. As shown in FIG. 4, the tail section 18 can be placed along the inseam 30 of any selected page of the book to mark the reader's place in the book. The tail section extends no farther than the bottom end E of book B when the tail section is in a unstretched condition. As shown in FIGS. 1 and 3–5, an ornamental marker 32 is attached to a distal end of tail section 18. The marker carries a "T" shaped anchoring element 34 that is interconnected between marker 32 and tail section 18. Marker 32 may have a disk shape and may be composed of a plastic or metal material. It is fused, crimped or otherwise bound to the cord of tail section 18. Marker element 32 may be approximately 0.0625" thick and 0.25" in diameter. These dimensions may again vary for differing sizes of bookmarks. In certain embodiments, approximately 1.5" of additional tail section may extend beyond the "T" shaped holder element, thereby allowing approximately 0.75" for attaching larger ornaments or markers.

Marker 32 and anchoring element 34 effectively form a tab at the end of the tail section. The reader can manipulate and position marker 32 so that it extends beyond an edge of the book, so as to mark a corresponding position in the book. For example, as shown in FIG. 4, marker 32 is grasped and pulled beyond edge E of book B. This edge may comprise either the upper or the lower edge of the book, although the bottom edge is more typical. The resilience of tail section 18 permits the cord to be pulled beyond edge E. Book B is then closed with tail section 18 extending along seam 30. As shown in FIG. 5, marker 32 is released so that holder element 34 engages edge E of book B. The slight stretch of the tail section 18 holds elements 32 and 34 securely in place so that the selected position in the book is effectively marked. All the while, loop section 16 remains grippably engaged with the cover of book B. While reading the book, the reader parks the bookmark tail section 18 between the last page and back cover of book B. The tail section remains in place because of the slight stretch of the cord, which pulls holder element 34 against the edge of the book and anchors the tab in place.

Figure 2:
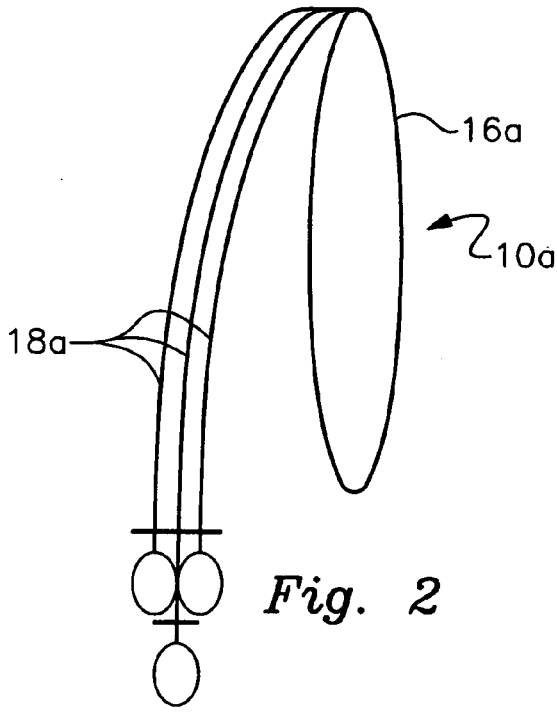
FIG. 2 is an elevational view of the bookmark employing multiple tail sections, which carry a respective marking tabs.

FIG. 2 depicts an alternative bookmark 10*a* having multiple tail section 18*a*. Once again, a single strand of approximately 1/32"–1/16" diameter elasticized string, typically micro-cord having 2:1 stretch, may be employed. A larger diameter cord may be used for larger bookmarks. The cord should be uniform in cross-sectional thickness. The cord may be approximately 39" long and differing lengths may be employed for different sized bookmarkers. The cord is initially double looped and is then fused, crimped or bound at approximately 6.25" to leave a tail strand of approximately 8.5". A longer tail section (e.g. 10.5") may be employed by larger bookmarks. By the same token, a larger or smaller loop section may be formed to accommodate different sizes of books. One of the oval loops is cut such that a single oval loop 16*a* remains. At the same time, three tail sections 18*a* are formed (two by the cut loop). The remaining loop section 16*a* is applied to the back cover of a book such that it encircles the inside and outside of the back cover with the three tail sections projecting from the top of the book. The loop section 16*a* temporarily attaches to the back cover of the book such that it becomes a part of the book until it is removed by the reader.

As in the prior embodiment, each tail section 18*a* may be placed freely along the inside seam of any page of the book in order to mark desired places or positions within the book. Ornamental markers carrying flat "T" top holder elements in disk shape, metal or plastic, are attached to the ends respectively of the tail sections. Alternatively, the marker may be formed by fused, crimped or bound cording. In any event, the marker may have a thickness of approximately 0.0625" and a diameter of approximately 0.25", although these sizes may be varied within the scope of this invention. As in the prior embodiment, the tail sections are stretched such that when they are released, the holder element holds the bookmark in place with a light stretch exerted on the cord of the tail section. Approximately 1.5" of additional tail may extend beyond the holder element thereby allowing approximately 0.75" for attaching larger ornaments or markers. Once again, the marker and retention element form a tab at one end of each tail, which the reader can manipulate and position as a marker. While reading the book, the reader will park the bookmarks between the last page and back cover of the book where they will stay put because of the slight stretch exerted by the cord.

An alternative preferred tab 133 is shown in FIG. 6. This tab is carried at the distal end of tail section 118. The tail section and the loop section, which is not shown, are composed of the string-like micro-cord, which is previously described. Tab 133 includes an anchoring element 134 and a grippable marking element 132 in the form of an ornamental charm. In this version, the charm is the depiction of a snowman, although a virtually endless variety of alternative designs may be employed.

Anchoring element 134 comprises a generally cup-shaped member having a plurality of notches 141 formed along its upper peripheral edge. The lower end of the cord comprising tail section 118 extends through a hole formed in the bottom of the cup-shaped anchoring element 134. The distal end of the cord includes a loop 143 that is formed by attaching the bottom end of tail section 118 to itself by an appropriate crimp 145 or other type of fastener. Marker 132 includes a grommet, ring or similar component 147 that interengages loop 143 to secure marker 132 to the lower end of tail section 118. Marker 132 and anchoring element 134 are thereby interconnected through loop 143.

Tab 133 is carried at the distal end of the tail section in either of any the embodiments of this invention. This tab is utilized in a manner analogous to the previously described versions. In particular, to mark a place in the book, the user attaches the loop section to a cover of the book as previously described. The distal end of tail section 118, including tab 133, is then placed between the selected pages of the book in a manner analogous to that shown in FIG. 4. Once again, with the tail in the unstretched condition, the tab does not extend beyond the bottom edge of the book. To mark his or her place in the book, the reader simply grasps grippable marker 132 and pulls the tail portion resiliently beyond the lower edge of the book. The book is then closed and the reader releases the marker so that the resilience of the tail portion pulls anchoring element 134 into interengagement with the lower edge of the pages of the book. These pages interengage notches 141, which holds the tail portion securely in place in the selected page position of the book. The whimsical and attractive ornamental charm 132 projects below the lower end of the book and reliably advises the user of the marked position. When the reader desires to resume reading the book, he or she simply grasps the marker 132 and opens the book to the marked position.

The bookmark devices of this invention provide for significant advantages over prior cover-engaging bookmarks. Because a thin, uniform diameter string-like micro-cord is utilized, the bookmark may be attached quickly and conveniently to all types of books, and especially even on a smaller paperback book, without damaging the book. The thick and cumbersome strap-like markers are not only unattractive, obtrusive and tedious and time consuming to install and remove, they or apt to damage the cover and/or pages of the book and are totally ineffective for use with paperback books. The present invention can be used safely and successfully on all types of books. Because the micro-cord loop is an elastic string and employs a very thin, yet uniform cross-sectional diameter, it slides easily and safely onto the cover of the book. Indeed, the thin, uniform diameter elastic cord will radially twist or rotate as indicated by arrows 99 in FIG. 5 as the loop is attached to or removed from the cover of the book. As a result, the book is not torn or damaged in any way. The thick flat straps of the prior art are not able to twist in the manner because they do not employ a thin and substantially uniform cross-sectional diameter as is used in the elastic string of this invention.

Apparatus 10 also is quite effective because it remains securely attached to the book to reliably mark the reader's place in the book. The bookmark is not likely to become dislodged and/or lost if the book is picked up, moved or dropped. The stretchable elastic maintains the bookmark in secure gripping attachment with the book. The anchoring element engages the bottom end of the book so that the reader's place is reliably and accurately maintained. The stretched, anchoring engagement that the tab achieves with the pages of the book holds the tail portion and the marker securely in place in a manner that is not exhibited in the prior art.

A further benefit the results from the thin dimension of the elastic cord is that the bookmark presents an extremely attractive and unobtrusive appearance. Due to the narrow diameter of the tail section (which becomes even narrower when the tail section is stretched), the book closes flat and completely about the bookmark. The variety of ornamental charms that may be employed in the tab present a varied and attractive appearance.

From the foregoing it may be seen that the apparatus of this invention provides for a bookmark, including a loop section and a tail section comprising a resilient string-like cord. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A bookmark device comprising:

an elastically stretchable loop section that includes a first longitudinally resilient cord wrappably attachable to a book in gripping engagement with the book such that said first cord extends across an exterior of the book and between front and back covers of the book at a selected location;

an elastically stretchable tail section including a second longitudinally resilient cord joined to and extending from said loop section, said tail section for projecting from a first end of the book to which said loop section is attached and being insertible between a selected pair of adjoining pages of the book to mark a corresponding position therein;

said first and second cords constituting a one-piece, longitudinally elastic string, said tail section having an unstretched length, as measured from the location at which said tail section and said loop section are joined to a distal end of said tail section, which unstretched length is not greater than the distance between said first end of the book and an opposite second end of the book; and a tab carried proximate said distal end of said tail section for being pulled to stretch said tail section beyond the opposite second end of the book and for being released such that said tail section elastically contracts and pulls said tab to engage the second end of the book and hold said tail section in place in the marked position of the book.

2. The device of claim 1 in which said string has a cross-sectional thickness of at least 1/64" and not greater than 1/16".

3. The device of claim 1 in which said string has a substantially uniform cross-sectional thickness.

4. The device of claim 1 in which said string is configured for radially twisting as said loop section is engaged with and disengaged from a book to facilitate attachment of said loop to and removal of said loop from the book.

5. The device of claim 1 in which said tab includes a grippable marking member that is grasped by a user for stretching and selectively positioning said tail and an anchoring element for engaging the pages at the second end of the book when said gripping member is released to hold said tail in place with a stretch in the marked position of the book.

6. The device of claim 5 in which said anchoring element includes a cup-shaped element having a plurality of notches formed along a peripheral edge thereof for receiving pages at the second end of the book to engage said anchor with those pages.

7. The device of claim 5 in which said marking member includes an ornamental charm.

8. The device of claim 5 in which said marking member and said anchoring element are attached to said second cord and interconnected by a second smaller loop formed proximate the distal end of said tail section.

9. A bookmarker device comprising:

an elastically stretchable loop section that includes a first longitudinally resilient cord wrappably attachable to a book in gripping engagement with the book such that said first cord extends across an exterior of the book and between front and back covers of the book at a selected location;

a plurality of elastically stretchable tail sections, each including a second, longitudinally resilient cord joined to and extending from said loop, each tail section for projecting from a first end of the book to which said loop is attached and being insertible between a selected pair of adjoining pages of the book to mark a corresponding position therein, all of said cords in said loop section and said tail section constituting a one-piece, longitudinally elastic string, each tail section having an unstretched length, as measured from the location at which said tail section and said loon section are joined to a distal end of said tail section, which unstretched length is not greater than the distance between said first end of the book and an opposite second end of the book; and a tab carried proximate a distal end of each said tail section for being pulled to stretch said tail section beyond an opposite end of the book and for being released such that said tail section elastically contracts and pulls said tab section to engage the second end of the book of the book and hold said tail section in place in the marked position of the book.

10. The device of claim 9 in which each cord comprises a micro-cord.

11. The device of claim 9 in which said string has a cross-sectional thickness of at least 1/64" and not greater than 1/16".

12. The device of claim 9 in which said string has a substantially uniform cross-sectional thickness.

13. The device of claim 9 in which said string in said loop section is configured for radially twisting as said loop section is engaged with and disengaged from a book to facilitate attachment of said loop to and removal of said loop from the book.

14. The device of claim 9 in which said tab includes a grippable marking member that is grasped by a user for stretching and selectively positioning said tail and an anchoring element for engaging the pages at the second end of the book when said gripping member is released to hold said tail in place with a stretch in the marked position of the book.

15. The device of claim 14 in which said marking member includes an ornamental charm.

16. The device of claim 14 in which said marking member and said anchoring element are attached to said second cord section and interconnected by a second smaller loop formed proximate the distal end of said tail.

17. A bookmark device comprising:

an elastically stretchable loop section that includes a first longitudinally resilient cord wrappably attachable to a book in gripping engagement with the book such that said first cord extends across an exterior of the book and between front and back covers of the book at a selected location;

an elastically stretchable tail section including a second longitudinally resilient cord joined to and extending from said loop section, said tail section for projecting from a first end of the book to which said loop section is attached and being insertible between a selected pair of adjoining pages of the book to mark a corresponding position therein;

said first and second cords constituting a one-piece, longitudinally elastic string, said tail section having an unstretched length as measured from the location at which said tail section and said loop section are joined to a distal end of said tail section, which unstretched length is not greater than the distance between said first end of the book and an opposite second end of the book; and a tab carried proximate said distal end of said tail section for being pulled to stretch said tail section beyond the opposite second end of the book and for being released such that said tail section elastically contracts and pulls said tab section to engage the second end of the book and hold said tail section in place in the marked position of the book;

said tab including a grippable marking member that is grasped by a user for stretching and selectively positioning said tail and an anchoring element for engaging the pages at the second page of the book when said gripping member is released to hold said tail section in place with a stretch in the marked position of the book;

said anchoring element including a cup-shaped element having a plurality of notches formed along a peripheral edge thereof for receiving pages of the second end of the book to engage said anchor element with those pages.

* * * * *